US006012953A

United States Patent [19]

Francis

[11] Patent Number: 6,012,953

[45] Date of Patent: Jan. 11, 2000

[54] SURFACE MOUNTABLE ELECTRICAL CONNECTOR SYSTEM

[75] Inventor: Dexter W. Francis, Salt Lake City, Utah

[73] Assignee: 3Com Corporation, Santa Clara, Calif.

[21] Appl. No.: 08/906,023

[22] Filed: Aug. 5, 1997

[51] Int. Cl.[7] ..... H01R 23/02

[52] U.S. Cl. ..... 439/676; 439/344; 439/76.1; 361/686

[58] Field of Search ..... 439/676, 76.1, 439/344, 946, 946.2, 329, 928.1, 638; 361/686

[56] References Cited

U.S. PATENT DOCUMENTS

| | | | |
|---|---|---|---|
| 5,118,311 | 6/1992 | Margini | 439/676 |
| 5,310,360 | 5/1994 | Peterson | 439/571 |
| 5,364,294 | 11/1994 | Hatch et al. | 439/676 |
| 5,403,207 | 4/1995 | Briones | 439/620 |
| 5,431,586 | 7/1995 | Klas et al. | 439/676 |
| 5,478,261 | 12/1995 | Bogese, II | 439/676 |
| 5,503,572 | 4/1996 | White et al. | 439/676 |
| 5,547,401 | 8/1996 | Aldous et al. | 439/676 |
| 5,580,274 | 12/1996 | Tsair | 439/571 |

*Primary Examiner*—Gary F. Paumen
*Assistant Examiner*—Tho D. Ta
*Attorney, Agent, or Firm*—Workman, Nydegger & Seeley

[57] ABSTRACT

A connector platform includes a base having a first end and opposing second end. A retention wall upwardly projects from the first end of the base and has a plurality of slots longitudinally extending therein. A plurality of resiliently flexible conducting wires each have a first end projecting from the first end of the base and a securing portion extending from the first end of the base to the second end thereof. Each conducting wire further includes an engaging portion upwardly projecting from the second end of the base to the retention wall. A second end of each conducting wire is freely disposed within a corresponding slot of the retention wall. The platform is selectively enclosed within the housing of an electrical apparatus. The housing defines an opening which provides access to the platform. The opening and platform combine to form a receptacle configured to receive a standard RJ-type plug.

17 Claims, 3 Drawing Sheets

SURFACE MOUNTABLE ELECTRICAL CONNECTOR SYSTEM

BACKGROUND OF THE INVENTION

1. The Field of the Invention

The present invention relates to telephone and data communication connectors and, more specifically to connectors for electrically coupling PC boards to communication lines.

2. The Relevant Technology

Electrical connectors such as RJ-type connectors provide an easy and quick method for coupling a data or telephone line, to a telephone, modem, or computer. Due to the simplicity of the connection and the corresponding standardized structure, RJ-type connections are used extensively in the telecommunication and computer industries. RJ-type connectors include a plug, or contact block and a receptacle or socket. The plug is attached to the end of an electrical cable or wire. The RJ plug is selectively received within a receptacle or socket which is secured to the hardware.

An RJ plug or contact block comprises a small block housing a plurality of distinct metal contacts which are discretely attached to different wires. A plurality of thin slots extend from the end of the block to each of the contacts. Mounted on the outside of the block is a flexible retention arm.

In complement, the receptacle comprises an integral housing having a socket formed therein. The housing is electrically coupled to the desired hardware. The socket has a plurality of flexible wires which are oriented to be received within corresponding slots of the RJ plug when the RJ plug is slid into the socket. The wires within the housing press against corresponding contacts on the RJ plug to complete electrical connection between the RJ plug and socket.

Formed on the roof of the socket is a recess. As the RJ plug is slid into the socket, the flexible retention arm on the RJ plug is initially compressed. The flexible retention arm is biased upward to engage the recess. Engagement between the retention arm and the recess locks the RJ plug within the socket. By later selectively compressing the flexible retention arm, the plug is released from the recess and the RJ plug can be easily removed from the socket.

Although used extensively, there are several shortcomings associated with conventional receptacles used with RJ plugs to make connectors. For example, the various electronic industries are continually struggling to miniaturize hardware. Increasingly, the receptacle housing is one of the larger internal components of the improved, slimmer and trimmer hardware. This is especially true where the receptacle is being mounted on a circuit board. Accordingly, the size of the receptacle is often the limiting factor in the size or thickness of a structure.

The relatively large size of the receptacle can also take up critical space on circuit boards which, under conventional standards, may be limited as to size. Furthermore, the large size of the receptacle can make it difficult to pick and place the receptacle on a circuit board using conventional equipment. This is because most equipment for picking and placing on a circuit board are designed for handling only very small components. As a result, the receptacle may have to be positioned manually.

An additional problem with conventional receptacles for RJ connectors is that the receptacle functions as both the structure for making the electrical contact and for mechanically securing the RJ plug to the hardware. It is a common occurrence that the wire attached to the RJ connector is pulled or tripped over, producing significant stress on the receptacle housing. To prevent the receptacle housing from breaking and to prevent the receptacle from being pulled out or displaced within the hardware, thereby severing the electrical connection, the receptacle must be structurally reinforced. In turn, this structural reinforcing increases the size of the receptacle, thereby further complicating the problems discussed above.

OBJECTS AND BRIEF SUMMARY OF THE INVENTION

Accordingly, it is an object of the present invention to provide improved apparatus for electrically coupling plugs to hardware.

Another object of the present invention is to provide improved apparatus for connectors where the receptacle is smaller than conventional receptacles.

Yet another object of the present invention is to provide improved connectors where the connector has a shorter height than conventional receptacles.

Yet another object of the present invention is to provide improved connectors where the connectors use less surface area on a circuit board than conventional receptacles.

Finally, it is an object of the present invention to provide improved connectors which reduce the mechanical stress placed on the electrical connection.

To achieve the foregoing objects, and in accordance with the invention as embodied and broadly described herein in the preferred embodiment, a surface mountable connector is provided. The plug includes a block having a first end and an opposing second end. A retention wall projects upwardly from the first end of the base and has a plurality of slots longitudinally extending therethrough. A plurality of resiliently flexible conducting wires each have a first end projecting from the first end of the base and a securing portion extending from the first end of the base to the second end thereof. Each conducting wire further includes an engaging portion upwardly projecting from the second end of the base to the retention wall. A second end of each conducting wire is freely disposed within a corresponding slot in the retention wall.

During use, a typical receptacle is attached to an electronic component. For example, the receptacle can be surface mounted on a circuit board with the first end of each of the conducting wires soldered or otherwise connected to leads on the circuit board. The receptacle and circuit board are next enclosed within the housing of the electrical device, such as a telephone, computer, or modem. The housing of the electrical device must include an opening to facilitate access by a plug to the receptacle. The opening is defined by a perimeter wall that is configured substantially complementary to the plug. When the plug passes through the opening and engages the receptacle, the discrete contacts on the receptacle are biased against a corresponding conducting wire on the plug. The receptacle captures the biased retaining arm on the plug. The plug and receptacle combine to form the connector.

In contradistinction, the inventive connector utilizes a conventional plug, but removes some of the receptacle structures to reduce the overall size of the connector. The removed structures are replaced by structures incorporated in the housing of the electrical device itself. Some of the receptacle functions in the inventive connector are incorporated into the opening in the housing of the device. When the plug passes through the opening, contact wires in a contact platform make electrical connection with corresponding wires on the plug. The walls of the opening itself have ridges designed to capture and engage the biased retaining arm of the plug. Thus, the plug and the walls of the opening in the housing of the device form the physical connection without the need for a separate receptacle. The contact platform facilitates the electrical connection. Only the contact platform is attached to the PC board. The contact platform, housing opening and plug make up the components of the inventive connector system.

The inventive connector system including the uniquely configured housing provide several advantages over conventional connectors. For example, since the inventive connector utilizes an opening in the housing, the portions of the receptacle such as the walls and roof are not required. The connector system may now have a smaller height, width, and surface area compared to conventional receptacles. This allows for better miniaturizing of structures in which any type of connection is desired. By minimizing the size of the receptacle, the connector can be easily surface mounted on a circuit board using conventional pick and place equipment. Finally, since the receptacle is limited solely to the function of providing electrical contact and does not perform the function mechanical engagement with the plug, the stresses produced are shifted to the device housing.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
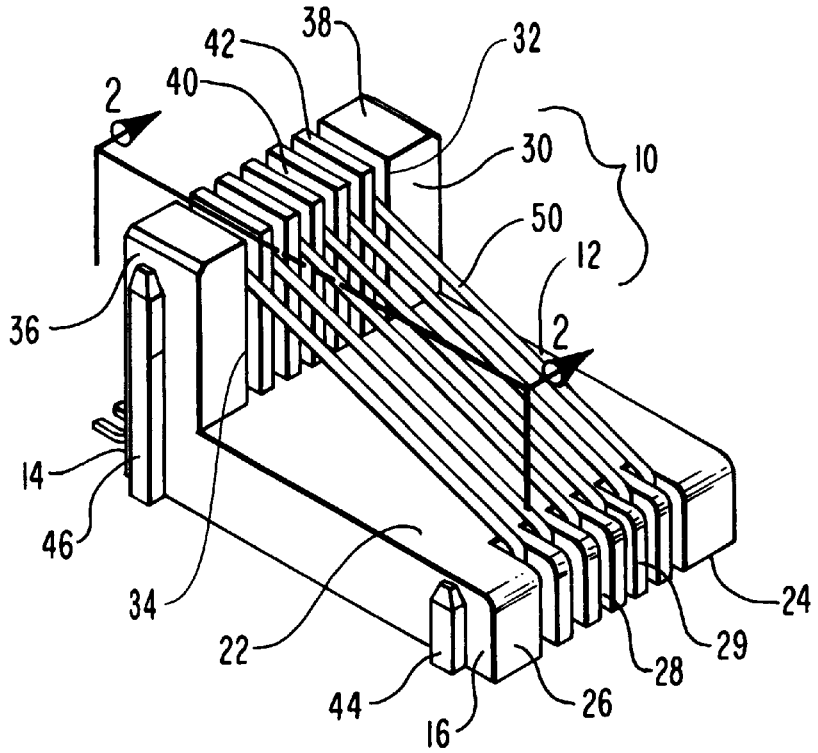
FIG. 1 is a perspective view of one embodiment of the contact platform.

Depicted in FIG. 1 is one embodiment of a platform 10 incorporating features of the present invention. As depicted therein, platform 10 comprises a substantially rectangular base 12 having a first end 14, an opposing second end 16. Second end 16 of base 12 terminates at an end face 26. A plurality of slots 28 are recessed within end face 26 and define a plurality of spaced apart insulating ribs 29. Base 12 further includes a top surface 22 and an opposing bottom surface 24.

Upstanding from first end 14 on top surface 22 of base 12 is a substantially rectangular retention wall 30. Retention wall 30 has opposing sidewalls 32 and 34 which extend from base 12 to a top end 36. Top end 36 of retention wall 30 terminates at a top face 38. A plurality of parallel slots 40 extend through retention wall 30 from top face 38 to base 12. Slots 40 define a plurality of parallel, spaced apart separating ribs 42.

Figure 2:
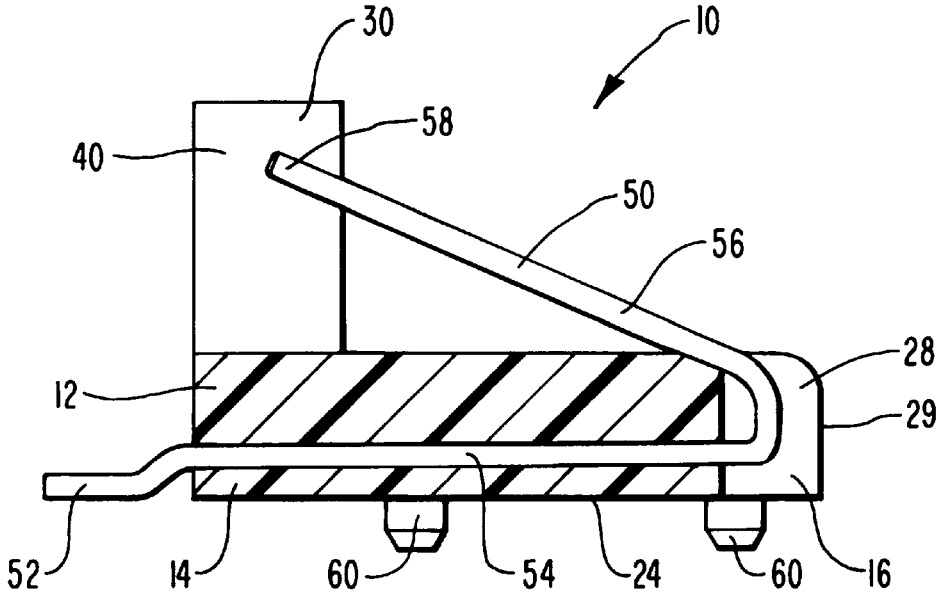
FIG. 2 is a cross-sectional side view of the platform shown in FIG. 1 taken along section lines 2—2.

An alignment ridge 44 projects from second end 16 of base 12. Alignment ridges 44 project in substantial parallel alignment with retention wall 30. Similarly, an alignment ridge 46 projects from first end 14 of base 12. Alignment ridges 46 also upwardly extend as to likewise project from retention wall 30. Alignment ridges 46 are also oriented substantially parallel with retention wall 30. As depicted in FIG. 2, a pair of alignment pegs 60 project from bottom surface 24 of base 12.

Platform 10 further includes a plurality of discrete conducting wires 50. As depicted in FIG. 2, each conducting wire 50 includes a first end 52 freely projecting from first end 14 of base 12. An adjacent securing portion 54 of conducting wire 50 extends from first end 14 of base 12 to second end 16 thereof. Specifically, securing portion 54 terminates within a corresponding slot 28 positioned at second end 16 of base 12. Conducting wire 50 further includes an engaging portion 56 extending from second end 16 of base 12 back to retention wall 30. Conducting wire 50 terminates at a second end 58 that is freely disposed within a corresponding slot 40 of retention wall 30. Engaging portion 56 of conducting wire 50 projects at an upward angle such that second end 58 is elevated above base 12.

In the described configuration, insulating ribs 29 keep the plurality of conducting wires 50 separated to prevent accidental shorting therebetween. Separating ribs 42 perform a similar function of keeping second end 58 of each conducting wire 50 separated and insulated. As discussed later, separating ribs 42 also act as guides during movement of second end 58 of each conducting wire 50.

Base 12 and retention wall 30 are preferably integrally molded from an insulating material, such as polycarbonate plastic, using conventional injection molding processes. Securing portion 54 of conducting wires 50 can be enclosed within base 12 during the molding process. Alternatively, small passageways can be longitudinally formed through base 12. Securing portion 54 can then be slid within a corresponding passageway and secured therein, such as with an adhesive.

Each conducting wire 50 is preferably formed of a resiliently flexible metal such as spring steel. Accordingly, as a downward force is applied to engaging portion 56, engaging portion 56 produces a biasing force back toward its original position.

Platform 10 is used for electronic coupling with a plug, such as an J-type plug. As used in the specification and appended claims, the term "plug" is intended to include all types and styles of connectors including RJ-type and other connectors for physical electrical connection of communication devices. By way of example and not by limitation, various types of RJ connectors which could be used for coupling with platform 10 include the "RJ-11" and "RJ-45." Platform 10, as depicted in FIGS. 1 and 2, is merely one embodiment of the invention. Platform 10 can of course vary to accommodate different types of RJ connectors. Different RJ connectors may require platform 10 to have a different number, sizing, and spacing of conducting wires 50 along with other modifications. The necessary modifications to platform 10 to enable coupling to different connectors would be known to those skilled in the art based on the disclosure herein.

Platform 10 can be used with any electrical equipment in which it is desirable to couple an RJ connector. By way of example and not limitation, conventional types of equipment which can use platform 10 include telephones, answering machines, personal computers, network systems, and modems.

Figure 3:
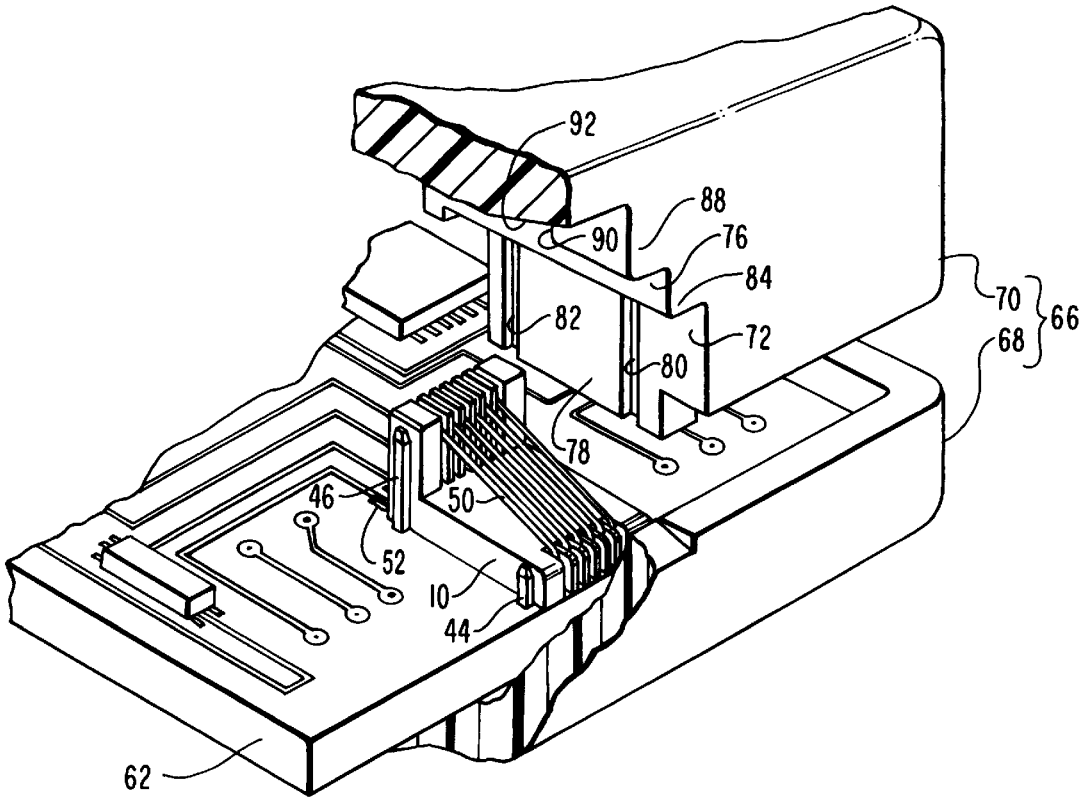
FIG. 3 is a perspective view of the platform shown in FIG. 1 mounted on a circuit board and enclosed within a housing.
Figure 4:
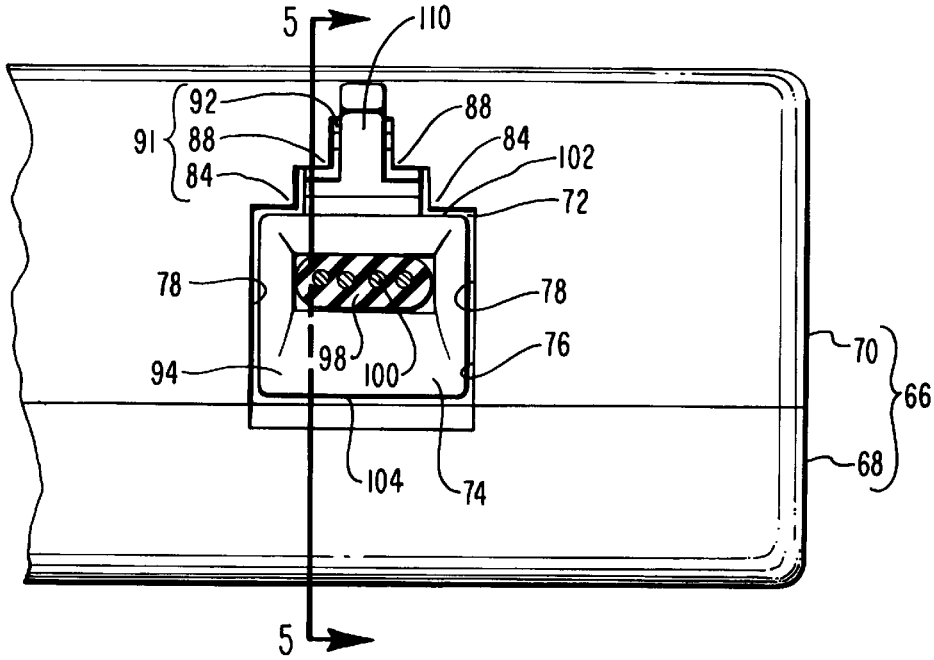
FIG. 4 is an elevated end view of an opening in the housing shown in FIG. 3 with an RJ plug received therein.
Figure 5:
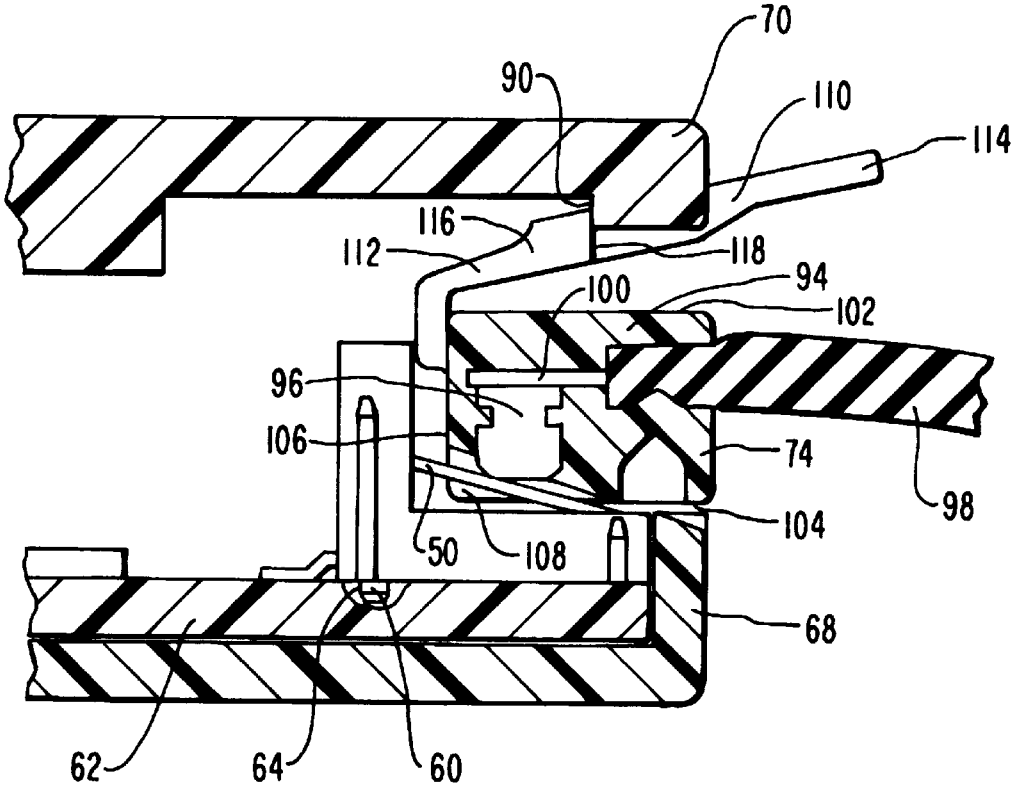
FIG. 5 is a cross-sectional side view of the components making the connector received within the opening of the housing shown in FIG. 4 taken along section lines 5—5.

By way of example as to how platform 10 is assembled with an electrical apparatus, depicted in FIGS. 3–4 platform 10 is surface mounted onto a circuit board 62. As depicted in FIG. 5, circuit board 62 includes apertures 64 which are configured to receive a corresponding alignment pin 60 so that platform 10 is properly positioned on circuit board 62. Returning to FIG. 3, in this position, first end 52 of each conducting wire 50 is soldered or otherwise connected to an appropriate lead on circuit board 62.

With platform 10 electrically coupled with circuit board 62, circuit board 62 and platform 10 are substantially enclosed within a housing 66. Housing 66 which, for example, could comprise the outside housing of a telephone, personal computer or other device, is depicted as comprising a base cover 68 and a top cover 70. Circuit board 62 and platform 10 are sandwiched between top cover 70 and base cover 68.

As depicted in FIGS. 3–4, the combined top cover 70 and base cover 68 form an opening 72 extending from the exterior to platform 10. Opening 72 enables a plug 74 to selectively attach with platform 10. Opening 72 is bounded by a perimeter wall 76 that is designed to receive plug 74 in proper alignment. Perimeter wall 76 in conjunction with platform 10 form a structure which is analogous to an RJ socket or receptacle. Perimeter wall 76 includes opposing sidewalls 78 each having a longitudinal first groove 80 configured to receive a corresponding alignment ridge 44 on base 12 and a longitudinal second groove 82 configured to receive a corresponding alignment ridge 46.

The inserting of alignment ridges 44 and 46 within corresponding grooves 80 and 82 facilitate proper positioning of RJ coupler 10 relative to housing 66 and helps to securely hold platform 10 between opposing sidewalls 78. Inwardly projecting from the top end of each sidewall 78 are opposing first ridges 84. Each first ridge 84 extends back to retention wall 30. Inwardly projecting above each first ridge 84 is a corresponding second ridge 88. Each second ridge 88 terminates at an end face 90 positioned only part way back toward retention wall 30. Extending between and above each second ridge 88 is a ceiling 92. First ridges 84, second ridges 88, and ceiling 92 combine to from a roof 91 extending between sidewalls 78.

As depicted in FIGS. 4 and 5, plug 74 comprises a contact block 94 housing a plurality of discrete metal contacts 96. A cable 98 is attached to contact block 94 and includes a plurality of discrete wires 100. Each wire 100 is connected to a corresponding contact 96. Contact block 94 includes a top surface 102, a bottom surface 104, and a front face 106. A plurality of sloped access slots 108 extend between front 106 and bottom surface 104 so as to openly expose a portion of each contact 96.

Projecting above contact block 94 is a flexible biased retention arm 110. Arm 110 includes a distal end 112 attached to contact block 94 and an opposing free proximal end 114. Radially projecting out from each side of arm 110 at distal end 112 are locking ramps 116. Each locking ramp 116 terminates at a face 118 projecting towards proximal end 114.

During use, plug 74 is selectively slid within opening 72 such that each contact wire 50 is received within a corresponding access slot 108 so as to bias against a discrete contact 96. This advancement of plug 74 causes each contact 96 to push down against engagement portion 56 of a corresponding conducting wire 50 so as to produce a continuous contact therebetween.

As plug 74 is inserted in to opening 72, retention arm 110 is initially pressed towards contact block 94 as locking ramps 116 pass under second ridges 88. After ramps 116 pass over second ridge 88, retention arm 110 extends up to selectively lock within opening 72. Face 118 of locking arm 110 is biased against end face 90 of second ridge 88. Removal of plug 74 is facilitated by merely depressing proximal end 114 of arm 110 and pulling plug 74 from opening 72.

The present invention also includes means for mechanically, releasably securing plug 74 within opening 72 in housing 66. By way of example and not by limitation, the means include second ridges 88 each having an end face 90 that locks against arm 110 as discussed above.

It will be appreciated that by obviating the need for a complete receptacle structure, some space savings may be enjoyed. The need for structures corresponding to side walls hasbeen removed thereby allowing a smaller footprint. Likewise, the need for a roof on the receptacle itself has been eliminated thereby allowing for a thinner card. The only remaining vertical structure, the retention wall, does not need to project upwardly from the base a distance greater than necessary to halt the forward progress of the plug. The retention wall may also be narrower than depicted to allow other components to take the space. Similarly, it will be appreciated that the retention wall may actually be replaced with a similar structure belonging to another component on the PC board. Such integration of function is in keeping with the spirit of this invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. In an electrical device having a housing with a opening formed therein that is adapted to physically receive a modular plug, a platform to facilitate electrical connection between the electrical device and the received plug, the platform comprising:

(a) a sideless base having a first end, an opposing second end, and a bottom surface that is adapted to be mounted directly to a top surface of a printed circuit board disposed within the electrical device;

(b) a retention wall upwardly projecting from the first end of the base and terminating at a freely disposed top end, the retention wall stopping the communication plug once the plug has been received a predetermined distance within the opening formed within the housing of the electrical device; and (c) at least one conducting wire having a first end adapted to be electrically connected directly to an electrical contact on the surface of the printed circuit board substantially adjacent to the base, and an opposing second end freely disposed within a slot formed in the retention wall to allow electrical connection between a contact on the plug received within the opening and the electrical contact on the printed circuit board.

2. A platform as recited in claim 1, wherein the first end of the conducting wire projects out of the first end of the base.

3. A platform as recited in claim 1, wherein the conducting wire further includes a securing portion extending from the first end of the base to the second end of the base.

4. A platform as recited in claim 1, further comprising a slot positioned at the first end of the base, the conducting wire being partially positioned therein.

5. A platform as recited in claim 1, further comprising:

(a) a plurality of vertically oriented, spaced apart slots extending through the retention wall; and (b) a plurality of conducting wires, each conducting wire having a second end freely disposed within a corresponding slot in the retention wall.

6. A platform as recited in claim 1, wherein the base and retention wall are comprised of a dielectric material.

7. A platform as recited in claim 1, further comprising an alignment ridge projecting from opposing sides of the base.

8. A platform as recited in claim 1, further comprising a pin projecting from the bottom of the base.

9. An electrical connector system to facilitate connection between a host device and a plug at the end of a communication line the system comprising:

(a) an opening formed within a housing of the host device, the opening being sized and shaped so as to physically receive and retain the plug in a manner so at least a portion of the plug is exposed to an interior of the host device housing:

(b) a printed circuit board disposed within the interior of the housing, the printed circuit board having a top surface portion that is positioned substantially adjacent to the recess and which has a plurality of electrical contacts formed thereon:

(c) a sideless, platform having:

a base with a bottom surface that is adapted to be mounted directly to the top surface portion of the printed circuit board, a single retention wall positioned on the platform so as to abut against an end of the plug when the plug has been received within the opening a predetermined distance, and a plurality of wires connected to the platform, said wires being capable of conveying electrical signals between corresponding contacts positioned on the plug and at least one of the plurality of electrical contacts on the printed circuit board when the plug is received within the opening of the host device housing.

10. A system as recited in claim 9, wherein the platform is "L" shaped.

11. An electrical apparatus operable with a communications plug and comprising:

(a) a platform completely enclosed within a housing of the electrical apparatus, the platform including:

i. a base having a first end, an opposing second end, and a substantially flat bottom surface capable of being mounted directly to a top surface of a printed circuit board that is positioned within the housing of an electrical device;

ii. a retention wall upwardly projecting from the first end of the base, the retention wall defining a plurality of vertically oriented slots; and iii. a plurality of resiliently flexible exposed conducting wires, each having a first end that extends from the platform so as to be directly connectible to a corresponding electrical contact on the top surface of the printed circuit board, and an opposing second end that projects from the second end of the base to the retention wall so as to be freely disposed within a corresponding slot in the retention wall;

and (b) an opening formed in the housing, the opening extending from an exterior of the housing to the platform and being shaped and sized so as to be capable of detachably receiving the communications plug, the opening being partially defined by a roof positioned adjacent to the retention wall and over the base such that the communications plug is positioned between the base of the platform and the roof when the communications plug is disposed within the opening of the housing.

12. An electrical apparatus operable with a plug and comprising:

(a) a printed circuit board having a top surface formed with a plurality of electrical contacts;

(b) a platform electrically connected with the printed circuit board, the platform including:

i. a base having a first end and an opposing second end and a base with a bottom surface that is mounted directly to the top surface of the printed circuit board, the bottom surface including at least one guide post that is adapted to be received within a corresponding recess formed in the surface of the printed circuit board;

ii. a retention wall upwardly projecting from the first end of the base, the retention wall defining a vertically oriented slot; and iii. a resiliently flexible exposed conducting wire, having a first end and an opposing second end, the conducting wire projecting from the second end of the base to the retention wall such that the second end of the conducting sire is freely disposed within the slot above the base, and the first end extends from the base so as to be capable of directly electrically connecting to at least one of the plurality of electrical contacts; and (c) a housing substantially enclosing the printed circuit board and the platform, the housing having an opening defined therein that extends from an exterior of the housing to a point that is substantially adjacent to the platform, the opening having a size and shape that is capable of at least partially receiving the plug and being partially defined by a roof positioned adjacent to the retention wall and over the base such that the plug is biased between the conducting wire and the roof when the plug is disposed within the opening of the housing.

13. An electrical apparatus as recited in claim 12, wherein the housing comprises a computer housing.

14. An electrical apparatus as recited in claim 12, further comprising means for mechanically, releasably securing the plug within the opening in the housing.

15. An electrical apparatus as recited in claim 12, wherein the opening in the housing is further defined by a sidewall extending from the roof to the base.

16. An electrical apparatus as recited in claim 12, wherein the first end of the conducting wire projects out the first end of the base.

17. An electrical apparatus as recited in claim 12, wherein the conducting wire further includes a securing portion extending from the first end of the base to the second end of the base.

* * * * *